US007055201B2

(12) United States Patent
Buchegger et al.

(10) Patent No.: US 7,055,201 B2
(45) Date of Patent: Jun. 6, 2006

(54) SURFACE TREATING MACHINE

(75) Inventors: Max Buchegger, Munchwilen (CH); Rene Principe, Munchwilen (CH); Dieter Windmeisser, Munchwilen (CH)

(73) Assignee: JohnsonDiversey, Inc., Sturtevant, WI (US)

( * ) Notice: Subject to any disclaimer, the term of this patent is extended or adjusted under 35 U.S.C. 154(b) by 265 days.

(21) Appl. No.: 10/122,731

(22) Filed: Apr. 15, 2002

(65) Prior Publication Data

US 2002/0178522 A1 Dec. 5, 2002

(30) Foreign Application Priority Data

May 31, 2001 (EP) ..... 01202074

(51) Int. Cl.
*A47L 11/00* (2006.01)

(52) U.S. Cl. ..... 15/49.1; 15/52; 15/97.1; 15/50.1

(58) Field of Classification Search ..... 15/49.1, 15/50.1, 97.1, 52, 79.2, 98; 73/818, 826
See application file for complete search history.

(56) References Cited

U.S. PATENT DOCUMENTS 2,956,296 A 10/1960 Ardido
5,922,968 A 7/1999 Briscoe

FOREIGN PATENT DOCUMENTS

DE 313 345 12/1928
DE 94 04 369 6/1994

OTHER PUBLICATIONS

European Search Report dated Oct. 26, 2001 on EP 01 20 2074.
Patent Abstracts of Japan of JP 06 141925, vol. 018, No. 451 (1994).

*Primary Examiner*—Gladys J. P. Corcoran
*Assistant Examiner*—Abraham Bahta
(74) *Attorney, Agent, or Firm*—Neil E. Hamilton; James J. Sales; Renee J Rymarz

(57) ABSTRACT

The invention relates to a surface treating machine which comprises a frame (1) and an undercarriage (2, 3) to enable the machine to move over a surface (S). A head (5) is supported by the frame and includes a drive motor (13) and a tool (6) for directly contacting, scrubbing or treating said surface (S). The tool is rotatably drivable by means of the motor.

Cardanic drive and coupling means (16) is connected to the tool (6) in a rotationally fixed manner on one end and connected to the drive motor (13) on the other end.

Support and spring means (8, 9, 17) for the tool (6), are forcing the tool (6) against the surface (S) with an controlled uneven pressure distribution around the circumference of the tool (6). The spring-like means (17) is distributed around an axis of rotation (12) of the support means (9), and is loaded such that the spring-like means (17) substantially remain biased during their rotation around the axis of rotation (12), in order to created a controlled uneven pressure distribution around the axis of rotation of the tool.

9 Claims, 6 Drawing Sheets

SURFACE TREATING MACHINE

The present invention relates to a surface treating machine having a frame and an undercarriage supporting a tool for contacting a floor.

Such a machine is known from EP-A-0 788 761. In this known machine, the support and spring means for the tool comprises a pressing wheel for varying the magnitude and position of the pressing force of the tool relative to the surface. In this way it is attempted to allow a user to adjust the pressing wheel in order to obtain the desired forward traction force from the tool depending on the conditions of the surface. In the embodiment of FIG. 3, the pressing wheel is provided with a coil spring as spring means in order to adjust the pressing force exerted by the pressing wheel.

The object of the present invention is to provide an improved surface treating machine.

For this purpose, the surface treating machine according to the invention is characterised by the features of the characterising portion of claim 1.

Due to the distribution of the spring-like means around the axis of rotation, a concentrated pressure at a distinct location on the tool is avoided. On the contrary, according to the invention, the pressure of the spring-like means is distributed over the entire circumference of the tool. This leads to a more homogeneous treating efficiency and, in the case of cleaning, avoids the danger of visible stripes. Furthermore, the distributed pressure on a tool ensures that the tool is fully in contact with the floor which not only leads to improved treating/cleaning performance, but also avoids abrupt behaviour changes of the machine due to variation in the traction between the tool and the surface or due to uneveness of the surface.

An advantageous embodiment of the machine according to the invention has the features of a support and spring means wherein a first support means is attached to the tool. A second support means is positioned at a distance from the first support means and fixed to the other end of the drive and coupling means. A spring-like means is positioned between the first and second support means to enable the first and second support means to swivel with respect to each other. The second support means is connected to the frame in a defined non-parallel orientation with respect to a surface.

In this embodiment, the uneven/non-symmetrical pressure distribution around the circumference of the tool is caused by the inclined or non-parallel orientation of the second support means relative to the first support means. This leads to a higher compression of the spring-like means at one (stationary) location on the circumference of the first and second support means and a gradual release of the compression towards an opposite location.

In practice, the orientation of the second support means will be fixed such that a pressure is exerted on the surface which results in a smooth forward drive, whereas normally occurring side forces are eliminated or at least reduced considerably. However, the orientation may be adjustable in order to adapt the machine to different conditions.

Preferably, not only the orientation of the axis of rotation is diverted from a vertical one, but it is also possible to offset the axis of rotation in lateral direction of the machine in order to approach the optimum theoretical centre of the pressure distribution and to obtain desired driving forces exerted by the tool on the machine.

A further advantage obtained by the invention is that tolerances in the first and second support discs and the angle in between do not lead to different behaviours between various machines, as the system according to the invention is able to compensate for these tolerances. This results in a simple and uncritical assembly without needs for adjustment.

The invention will hereafter be further explained with reference to the drawings showing an embodiment of the surface treating machine according to the invention.

Figure 1:
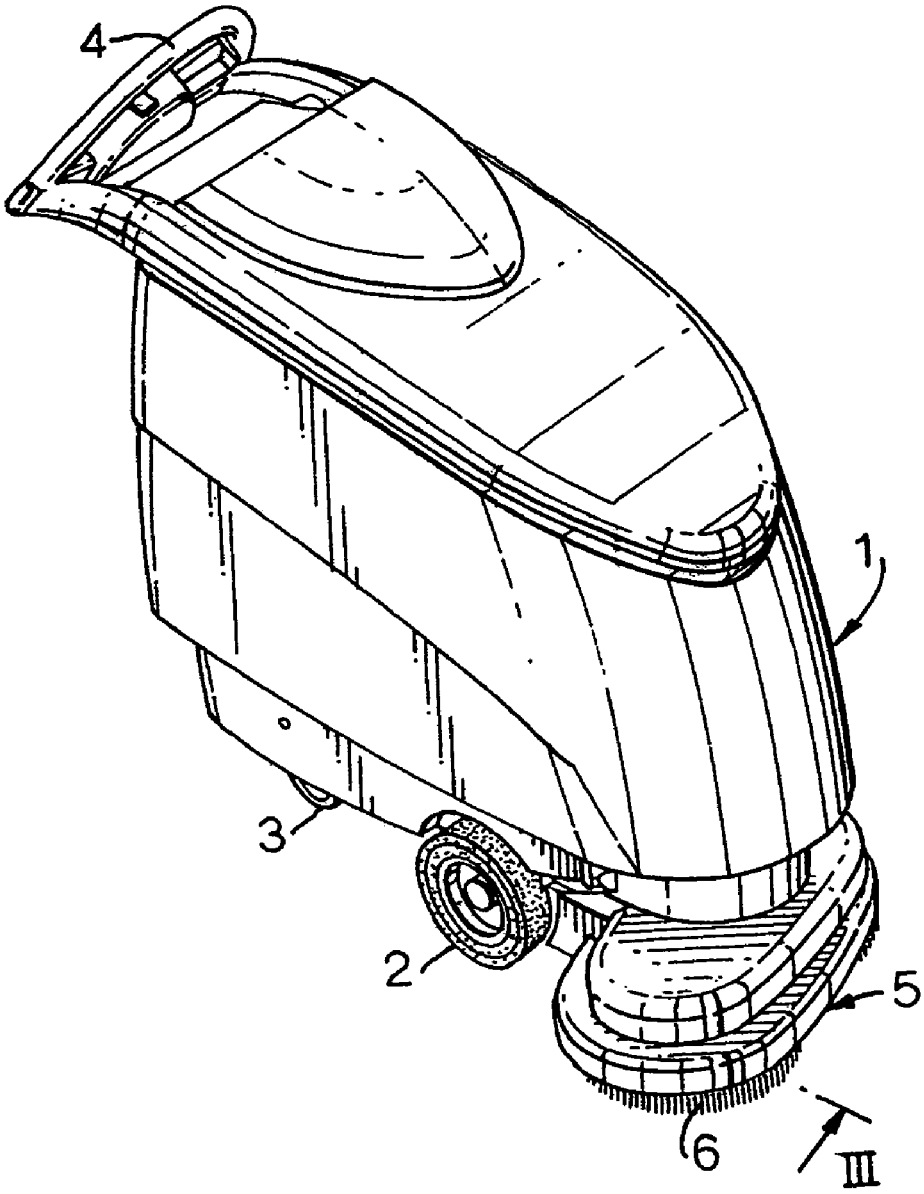
FIGS. 1 and 2 are perspective views of the embodiment of the surface treating machine according to the invention.
Figure 2:
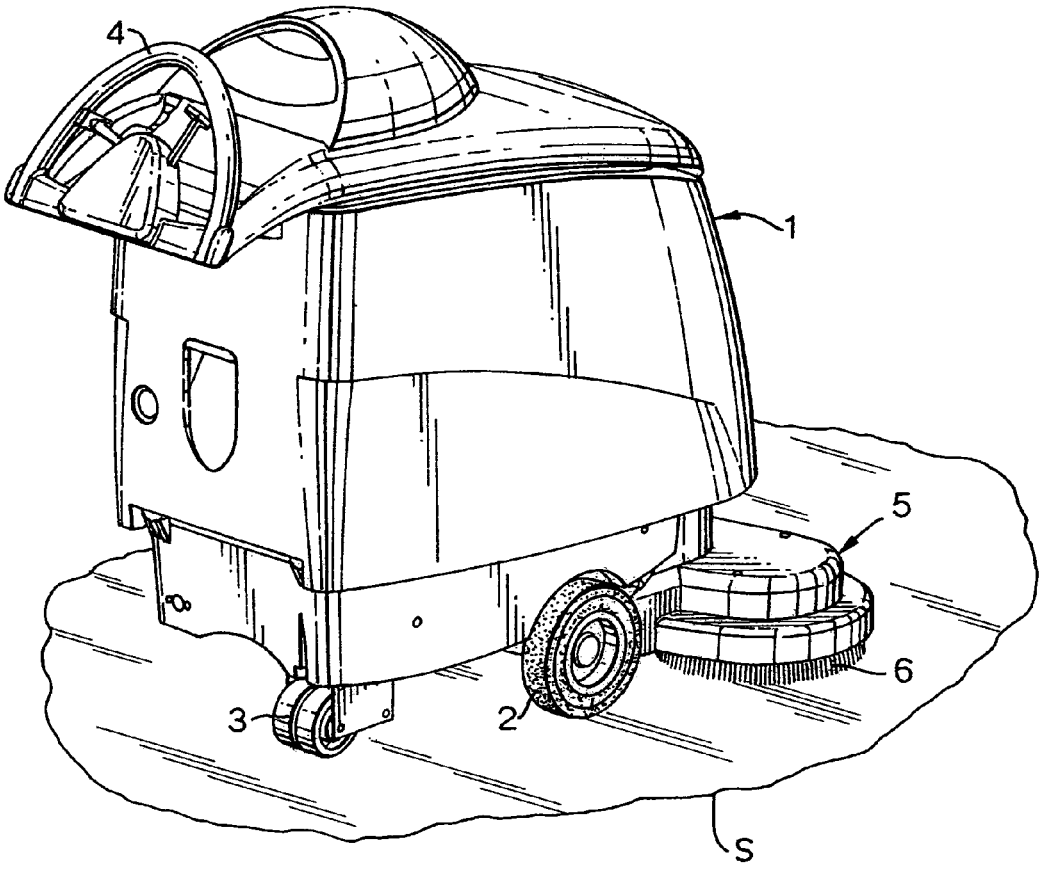

The drawings, and in first instance FIGS. 1 and 2, show an embodiment of a surface treating machine, in this case a so-called scrubber dryer machine used to clean large area floors in buildings. It should be understood that the invention can be used in all kinds of other machines for treating or cleaning surfaces.

The machine comprises a body of frame 1 and an undercarriage 2, 3 to enable the machine to move over a surface or floor S. The undercarriage includes in this case two front wheels 2 and at the rear double castor wheels 3 so that the machine is supported by the undercarriage 2, 3 in a defined orientation with respect to the surface S. In use, an operator is walking behind the machine and is steering it through a steering bar 4 or the like.

The machine further comprises a head 5 including a tool 6, such as a disc-shaped brush, to act on the floor S.

Figure 3:
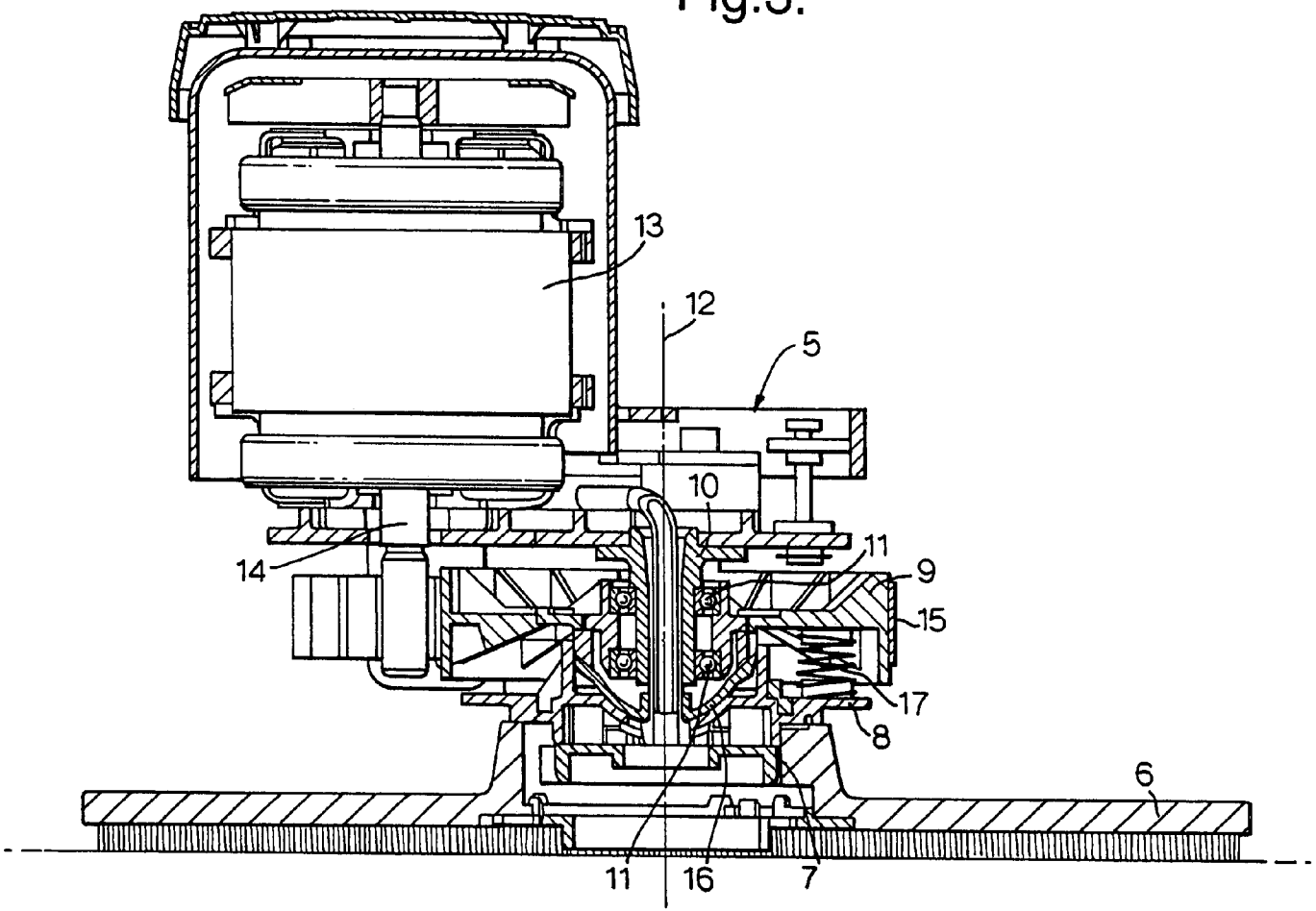
FIG. 3 is a sectional view along the line III—III in FIG. 1, on a larger scale, showing the head of the machine according to FIGS. 1 and 2.

FIG. 3 shows the head 5 of the machine in more detail. It shows that the tool 6 is in a form of a disc which is removably coupled by means of a coupling 7 to first support means 8 which is more or less in the form of a disc. The first support disc 8 is connected to a second support means or disc 9 having a circumferential flange. This second support disc 9 is rotatably supported on a stationary shaft 10 through roller bearings 11, and is positioned at a distance from the first support disc 8.

The second support disc 9 is rotatably drivable around an axis of rotation 12 by means of an (electric) motor 13, in this case through a belt drive comprising a motor pulley 14 and a belt 15 guided around the pulley 14 and the circumferential flange of the second support disc. The axis of rotation 12 is formed by the fixed shaft 10. Of course, other drive means and transmission means are conceivable. The torque from the second support disc 9 is transmitted to the first support disc 8 through a cardanic coupling 16 (including a spherical cap and hexagon) in order to drive the tool 6, but to allow a swivelling motion thereof with respect to the second support disc 9.

Figure 4:
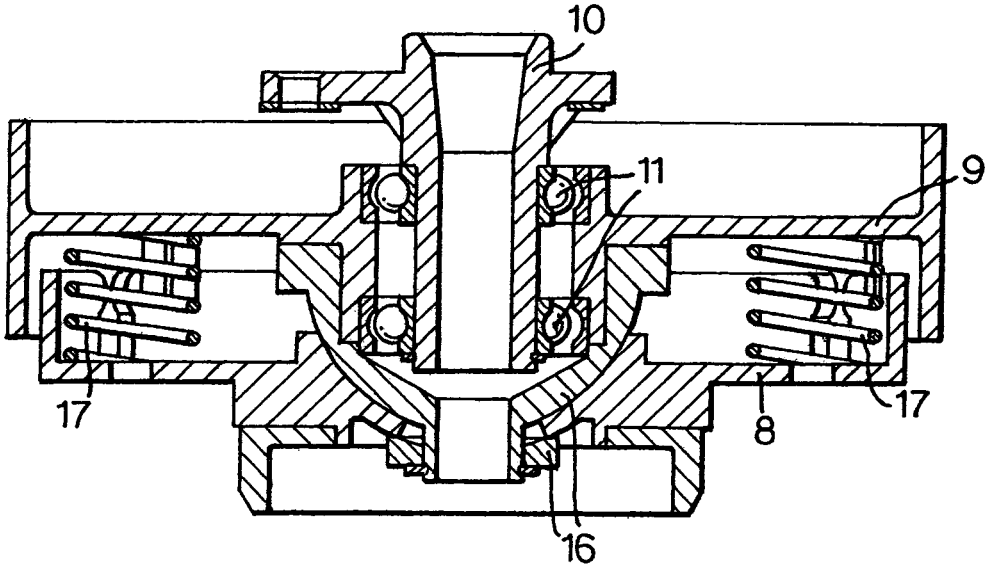
FIGS. 4 and 5 show vertical sectional views of the head of FIG. 3, in two different positions.
Figure 5:
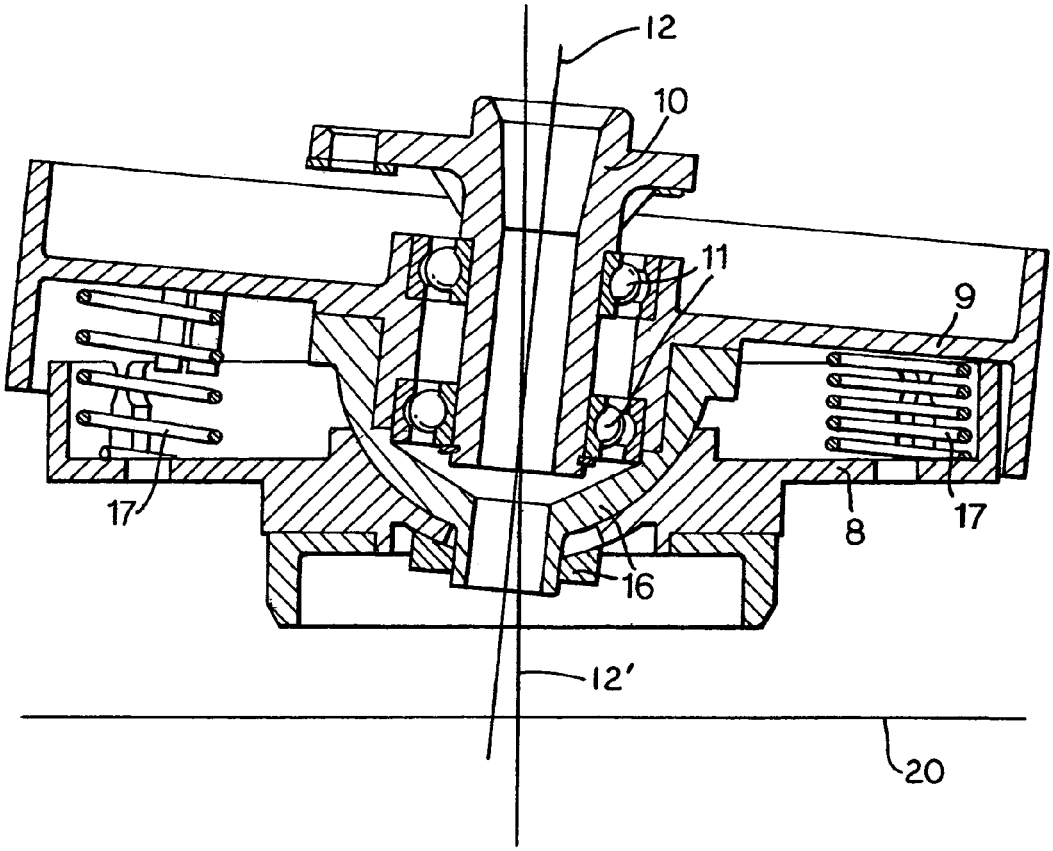

Between the first and second support discs 8 and 9 there are provided 6 to 12 spring-like means, in this case coil springs 17 which are distributed around the axis of rotation 12. The coil springs exert a pressure force onto the first support disc 8 which is chosen according to the aimed tool-pressure in relation to the relative position of the cleaning/scrubbing means and the machine weight. The pressure force is for example between 50 and 200 N. The springs 17 will urge the first support disc 8 and therefore the tool 6 to a symmetrical position with respect to the second support disc 9 (see FIG. 4). The springs 17 will counteract a relative rotation between the discs 8 and 9 around a horizontal axis 20 as is shown in FIG. 5. In the situation of FIG. 5, the axis of rotation 12' of the tool 6 and first support means 8 is not aligned with the axis of rotation 12 of the second support means 9. The axis of rotation 12' of the tool 6 will be determined by the surface S and will generally be perpendicular to this surface S. The axis of rotation 12 is determined by the orientation of the shaft 10.

The whole head 5 of the unit is adjustably mounted to the frame 1, at least such that the head 5 and therefore the shaft 10 may rotate with respect to the frame 1 around an axis substantially perpendicular to the longitudinal axis of the machine. This rotation can preferably be within the range of 5 to 10 degrees with respect to the horizontal. This rotation is provided in order to obtain a position of the second support disc as is shown in FIG. 5. In this position there is created an angle between the first support disc 8 (which will remain parallel to the surface S to be maintained) and the second support disc 9 such that a controlled uneven pressure distribution on the first support disc 8 and therefore the tool 6 will be caused by the coil springs 17. This will create a pressure centre of the tool 6 outside the centre of the tool. If this pressure centre is positioned on the side of the tool 6 which rotates rearwardly with respect to the machine, it means that the tool 6 will exert a forwardly directed force onto the machine, causing a propulsion on the machine.

Figure 6:
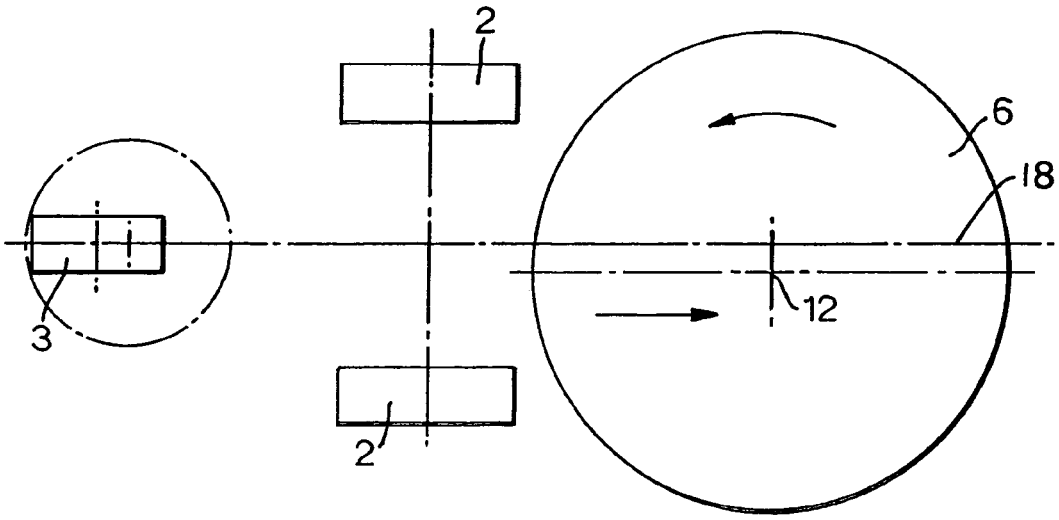
FIG. 6 is a plan view of the geometry of the head and undercarriage of the machine according to the invention.

FIG. 6 shows that the axis of rotation 12 of the tool 6 is also offset with respect to the longitudinal centre line 18 of the machine which will bring the pressure centre of the tool 6 closer to the longitudinal centre line of the machine and this will further improve the propulsional force exerted by the tool 6 on the machine and will lead to decreased lateral forces and a decrease of undesired torsional forces on the machine.

During the rotation of the discs 8, 9 around the axis of rotation 12, all springs 17 are compressed and released consecutively and create a pressure distribution on the tool without any peaks. This will improve the cleaning efficiency of the tool 6 and will avoid the danger of visual stripes on the surface to be maintained.

The invention is not restricted to the embodiment shown in the drawing and described hereinbefore, but may be varied in different manners within the scope of the accompanying claims. For example, it is possible to use all kinds of other springs, or rubber spring-like elements, rather than coil springs as shown.

The invention claimed is:

1. A surface treating machine, comprising:

a frame and an undercarriage to enable the machine to move over a surface (S) such as a floor or wall in a defined orientation with respect to the surface;

a head supported by the frame, said head including:

a drive motor;

a single tool for directly contacting, scrubbing or treating said surface (S), said tool being rotatably drivable by means of the motor, said tool driving the machine;

cardanic drive and coupling means connected to the tool in a rotationally fixed manner on one end and connected to the drive motor on another end;

support and spring means for the tool, under which the tool is arranged, said support and spring means in use, forcing the tool against the surface (S) with a controlled uneven pressure distribution around a circumference of the tool;

wherein the spring means is distributed around an axis of rotation of the support means, and is loaded such that the spring means substantially remain biased during their rotation around the axis of rotation of the support means.

2. A machine according to claim 1, wherein the support and spring means comprises:

first support means to which the tool is attached;

second support means positioned at a distance from the first support means and fixed to the other end of the drive and the coupling means; and spring means between the first and second support means positioned to enable the first and second support means to swivel with respect to each other, wherein the second support means is connected to the frame in a non-parallel orientation with respect to the surface (S).

3. The machine according to claim 2, wherein the spring means comprises a plurality of coil springs evenly distributed around the axis of rotation of the second support means with one end of the coil spring connected to the first support.

4. The machine according to claim 1, wherein the spring means comprises 6 to 12 coil springs and the spring force per spring being 50–200 N.

5. The machine according to claim 2, wherein the second support means rotates around a stationary shaft and is driven by the motor.

6. The machine according to claim 5, wherein the second support means is driven by the drive motor through a belt transmission.

7. The machine according to claim 5, wherein the head is attached to the frame in an adjustable manner such that the orientation of the the second support means is adjustable.

8. The machine according to claim 1, further including a shaft and wherein the head is adjustably supported to the frame in a manner that the head and the shaft rotate with respect to the frame around an axis at an angle in the range of 5 to 10° with respect to a surface.

9. The machine according to claim 1, wherein the axis of rotation of the support and spring means is offset laterally with respect to the longitudinal centre axis of the machine, in a direction opposite to the side where a pressure centre of the tool is located.

* * * * *

UNITED STATES PATENT AND TRADEMARK OFFICE

CERTIFICATE OF CORRECTION

PATENT NO. : 7,055,201 B2
APPLICATION NO. : 10/122731
DATED : June 6, 2006
INVENTOR(S) : Max Buchegger, Rene Principe and Dieter Windmeisser It is certified that error appears in the above-identified patent and that said Letters Patent is hereby corrected as shown below:

Col. 4, Claim 2, Lines 20-21
Currently reads: "spring means between the first and second support means positioned to enable the first and second support means"
Should read: "spring means positioned between the first and second support means to enable the first and second support means"

Signed and Sealed this

Twenty-eighth Day of November, 2006

JON W. DUDAS
*Director of the United States Patent and Trademark Office*